US009892613B2

(12) United States Patent
Birnie et al.

(10) Patent No.: US 9,892,613 B2
(45) Date of Patent: Feb. 13, 2018

(54) METHOD AND APPARATUS FOR MAINTAINING ALERTNESS OF AN OPERATOR OF A MANUALLY-OPERATED SYSTEM

(71) Applicants: Andrew Birnie, Bearsden (GB); Derek Beattie, Giffnock (GB); Robert Moran, Largs (GB)

(72) Inventors: Andrew Birnie, Bearsden (GB); Derek Beattie, Giffnock (GB); Robert Moran, Largs (GB)

(73) Assignee: NXP USA, Inc., Austin, TX (US)

( * ) Notice: Subject to any disclaimer, the term of this patent is extended or adjusted under 35 U.S.C. 154(b) by 105 days.

(21) Appl. No.: 14/430,923

(22) PCT Filed: Oct. 10, 2012

(86) PCT No.: PCT/IB2012/055469
§ 371 (c)(1),
(2) Date: Mar. 25, 2015

(87) PCT Pub. No.: WO2014/057308
PCT Pub. Date: Apr. 17, 2014

(65) Prior Publication Data
US 2015/0269829 A1 Sep. 24, 2015

(51) Int. Cl.
*G08B 23/00* (2006.01)
*G08B 21/06* (2006.01)
*G08B 3/10* (2006.01)
*G08B 5/36* (2006.01)

(52) U.S. Cl.
CPC ..... *G08B 21/06* (2013.01); *G08B 3/10* (2013.01); *G08B 5/36* (2013.01)

(58) Field of Classification Search
None
See application file for complete search history.

(56) References Cited

U.S. PATENT DOCUMENTS 3,922,665 A * 11/1975 Curry ..... B60K 28/06 180/272
4,540,979 A 9/1985 Gerger et al.
5,012,226 A * 4/1991 Love ..... G08B 21/06 180/272
5,952,928 A * 9/1999 Washington ..... G08B 21/06 340/309.3
6,154,123 A * 11/2000 Kleinberg ..... G08B 21/06 180/169
7,652,583 B2 * 1/2010 Sanchez ..... B60K 28/066 340/575
7,982,620 B2 7/2011 Prokhorov et al.
(Continued)

OTHER PUBLICATIONS

International Search Report and Written Opinion correlating to PCT/IB2012/055469 dated Jul. 7, 2014.

*Primary Examiner* — Julie Lieu

(57) ABSTRACT

An apparatus for maintaining alertness of an driver of a motor vehicle periodically generates an audible alert signal to which the driver responds by pressing a button on the vehicle's steering wheel. The response time of the driver to the signal is monitored and if an increase is detected, the repetition rate of the alert signal is increased. The repetition rate may be further modified by taking into account vehicle driving conditions which may indicate a risk of boredom in the driver.

20 Claims, 2 Drawing Sheets

(56) References Cited

U.S. PATENT DOCUMENTS

| | | | | |
|---|---|---|---|---|
| 8,022,831 | B1 * | 9/2011 | Wood-Eyre | B60T 7/14 180/272 |
| 2002/0171553 | A1 * | 11/2002 | Omry | B60K 28/066 340/576 |
| 2005/0030184 | A1 * | 2/2005 | Victor | B60K 28/06 340/576 |
| 2008/0154438 | A1 * | 6/2008 | Kalik | A61B 5/18 701/1 |
| 2008/0231461 | A1 * | 9/2008 | Sanchez | G08B 21/06 340/575 |
| 2009/0261979 | A1 * | 10/2009 | Breed | B60J 10/00 340/576 |
| 2009/0267777 | A1 * | 10/2009 | Kumar | G08B 21/06 340/576 |
| 2009/0284361 | A1 | 11/2009 | Boddie et al. | |
| 2010/0141415 | A1 * | 6/2010 | Power | G08B 21/06 340/439 |
| 2011/0043350 | A1 * | 2/2011 | Ben David | B60Q 9/00 340/441 |
| 2011/0121960 | A1 | 5/2011 | Tsai | |
| 2011/0193707 | A1 | 8/2011 | Ngo | |
| 2011/0205070 | A1 * | 8/2011 | Kumar | G08B 21/06 340/576 |
| 2016/0167672 | A1 * | 6/2016 | Krueger | A61M 21/00 340/576 |

* cited by examiner

METHOD AND APPARATUS FOR MAINTAINING ALERTNESS OF AN OPERATOR OF A MANUALLY-OPERATED SYSTEM

FIELD OF THE INVENTION

This invention relates to a method and apparatus for maintaining alertness of an operator in a manually-operated system and has particular application to maintaining the alertness of a driver of a vehicle.

BACKGROUND OF THE INVENTION

Driving is a highly visual task but accident statistics show that driver inattention is a contributory factor in the majority of accidents. Recent data from the United States Department of Transport indicates that in certain circumstances, doing menial tasks, like carrying on a conversation with a passenger, helps to maintain the drivers attention and hence reduce the probability of an accident. Various schemes have been proposed for monitoring the alertness of a driver of a vehicle.

For example, U.S. Pat. No. 5,012,226 describes a system which provides a visual activation of some device at set intervals and then waits for the driver to activate a switch to indicate awareness.

U.S. Pat. No. 6,154,123 describes a similar system which uses voice recognition technology to record the driver's verbal acknowledgement that he has noticed a visual prompt.

These known systems provide means for detecting whether a driver is alert or not but cannot necessarily maintain a state of alertness in the driver.

SUMMARY OF THE INVENTION

The present invention provides a method and apparatus for maintaining alertness of an operator of a manually-operated system, such as a motor vehicle, as described in the accompanying claims.

Specific embodiments of the invention are set forth in the dependent claims.

These and other aspects of the invention will be apparent from and elucidated with reference to the embodiments described hereinafter.

BRIEF DESCRIPTION OF THE DRAWINGS

Further details, aspects and embodiments of the invention will be described, by way of example only, with reference to the drawings. In the drawings, like reference numbers are used to identify like or functionally similar elements. Elements in the figures are illustrated for simplicity and clarity and have not necessarily been drawn to scale.

DETAILED DESCRIPTION

Because the illustrated embodiments of the present invention may for the most part, be implemented using electronic components and circuits known to those skilled in the art, details will not be explained in any greater extent than that considered necessary as illustrated herein, for the understanding and appreciation of the underlying concepts of the present invention and in order not to obfuscate or distract from the teachings of the present invention.

Although the examples given herein are described with reference to a manually-operated system which comprises a manually-driven vehicle such as a passenger car or automobile, it will be understood that the principles and concepts described may be equally applicable to other manually-operated systems. For example such systems could comprise industrial machinery, an aircraft, a seagoing vessel to name but a few.

Figure 1:
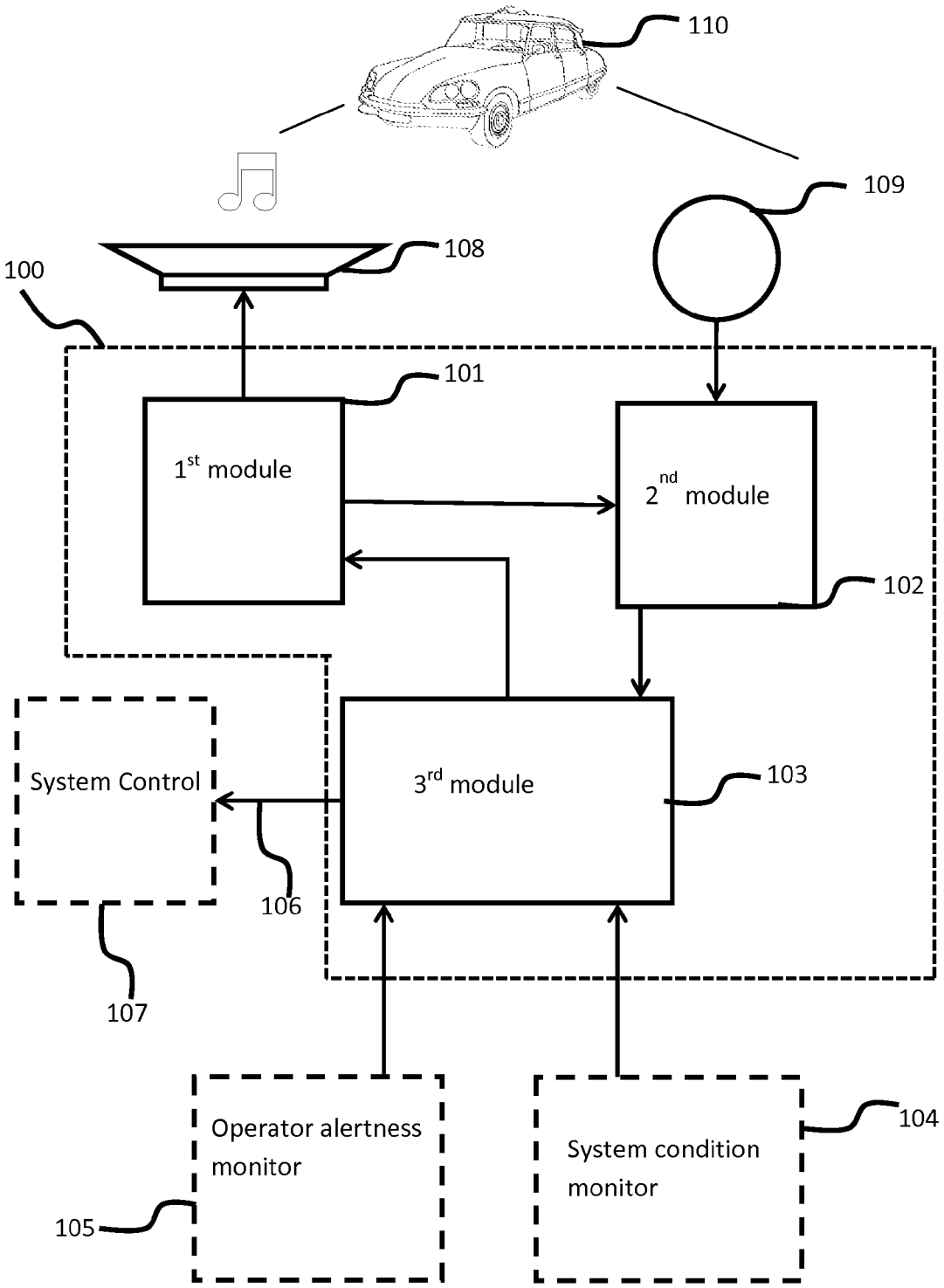
FIG. 1 shows a simplified block diagram of an example of an apparatus for maintaining alertness of an operator of a manually-operated system.

With reference to FIG. 1, an apparatus 100 for maintaining alertness of an operator of a manually-operated system comprises a first signal processing module 101 operably coupled with a second signal processing module 102 and with a third signal processing module 103. The second and third modules 102, 103 are also operably coupled to one another. The apparatus 100 may receive inputs from external devices which form a part of the manually-operated system. For example, the apparatus 100 may receive a signal from a system condition monitor 104 (ie. a monitor for monitoring one or more conditions, for example, operating conditions, of the manually-operated system). The apparatus 100 may also receive a signal from an operator alertness monitor 105. The apparatus 100 may generate and output a control signal 106 for use by a system control device 107 (ie. a device for controlling the manually-operated system).

An output of the first signal processing module 101 may be connected to a loudspeaker 108 for producing an audible alert signal for detection by the operator. A manually-operated input device 109, which may be a pushbutton for example, has an output which is connected to the second signal processing module 102.

In an alternative example, the apparatus 100 produces a visual alert signal rather than an audible one. In a further alternative example, the apparatus 100 produces a haptic alert signal.

The first signal processing module 101 is arranged to generate the alert signal at a variable repetition rate. The repetition rate is determined by the third signal processing module 103 and notified to the first signal processing module 101. The repetition rate may be determined with reference to a signal received from the second module 102 and to a signal received from the external devices 104 and 105. The volume of an audible alert signal may also be varied by the first module 101 in response to an adjustment signal from the third module 103. Where the alert signal may be a visual or haptic signal, these signals may also be varied. For example, the brightness or size of a visual alert may be varied. In another example, a haptic signal may become longer or stronger vibrations stop The pushbutton 109 provides the means for the operator to acknowledge that he has heard an alert signal. The operator's response time, which is defined as the time which elapses between generation of the alert signal and the operator pushing the button, is monitored by the second module 102 and passed on to the third module 103. The value of this response time as monitored by the second module 102 may be used by the third module 103 to adjust the repetition rate of the alert signal.

The third module 103 may also make an adjustment to the repetition rate of the alert signal depending on an input from the system condition monitor 104. Such a system condition monitor may give an indication of the level of workload that the operator is currently engaged in and may, for example, indicate that the current workload is low such that the operator may become bored.

The third module 103 may also make an adjustment to the repetition rate of the alert signal depending on an input from the operator alertness monitor 105. Such a monitor may give an indication of the operator's current level of concentration.

The output 106 of the third module 103 may be used by the system control device 107 to modify the system in some way. For example, if it is noted by the apparatus 100 that the operator's response time has exceeded a predetermined value then certain operating parameters of the system (for example, a vehicle) may be adjusted or the system may be disabled for the sake of safety.

In one exemplary embodiment, the manually operated system may be a vehicle and the operator, the driver of the vehicle. The apparatus 100 may then be incorporated in a vehicle 110 Hence, the apparatus 100 of FIG. 1 may be employed to maintain the alertness of the driver, while he/she is driving the vehicle 110, by periodically generating an alert signal via the loudspeaker 108. The loudspeaker 108 may be a stand-alone device mounted inside the vehicle 110 and connected to the apparatus 100. Alternatively, the audio system (not shown) of the vehicle 110 may be used, with the necessary connections being made to the apparatus 100 as appropriate. Further modifications may be made to the audio system so that if the radio is on or an in car telephone conversation is in progress, these are muted while the alert signal is sounded. The audible alert signal may comprise a ping or a chime.

In an alternative example where the alert signal is a visual one, a lamp on the dashboard of the vehicle 110 may be periodically illuminated by a signal from the first module 101.

In a further example, where the alert signal is a haptic one, the steering wheel, for example may be arranged to vibrate on receipt of the periodic alert signal from the first module 101.

The manually-operated input device 109 may be a push-button mounted on the steering wheel of the vehicle or at some other location within easy reach of the driver's fingers. Alternatively, the input device may be incorporated in the steering wheel and arranged to be sensitive to being squeezed by the driver's fingers In the motor vehicle example, the system condition monitor 104 may comprise any number of on-board sensors which indicate the current driving condition of the vehicle 110. For example the various control management systems in a vehicle can readily monitor steering angle deflection, braking effort, gear shifts and vehicle speed. Outputs from such sensors can give an indication of the workload of the driver, driving style and boredom risk. For example if there are frequent steering and gear changes then the driver's workload is relatively high and it is unlikely that he/she will become bored. However, if there have been no steering or gear changes and the speed has been constant for a certain length of time, then there is a risk that the driver will become bored stop these factors may be taken into account by the third module 103 in determining if an adjustment to the repetition rate of the alert signal is appropriate.

In the vehicle example, the operator alertness monitor 105 may comprise any number of on-board sensors which monitor the driver's activities or physical state. One known system monitors the drivers heartrate. In another example, a head position sensor can monitor head movements of the driver to indicate if his/her eyes have been taken off the road for any length of time. Such behaviour may indicate a lapse in concentration. These factors may be taken into account by the third module 103 in determining if any adjustments to the alert signal repetition rate is appropriate.

In the vehicle example, the system control module 107 may comprise any number of on-board controllers which may generate signals for modifying the behaviour of the vehicle 110. For example, such a system control module may cause the speed of the vehicle to be reduced. It may switch off a set cruise control mechanism or switch on the air conditioning or increase the volume of the radio. Such actions may be taken in order to raise the alertness level of the driver when it may be detected by the apparatus 100 that he is becoming bored or distracted or possibly falling asleep because his response time has increased beyond a predetermined level.

Figure 2:
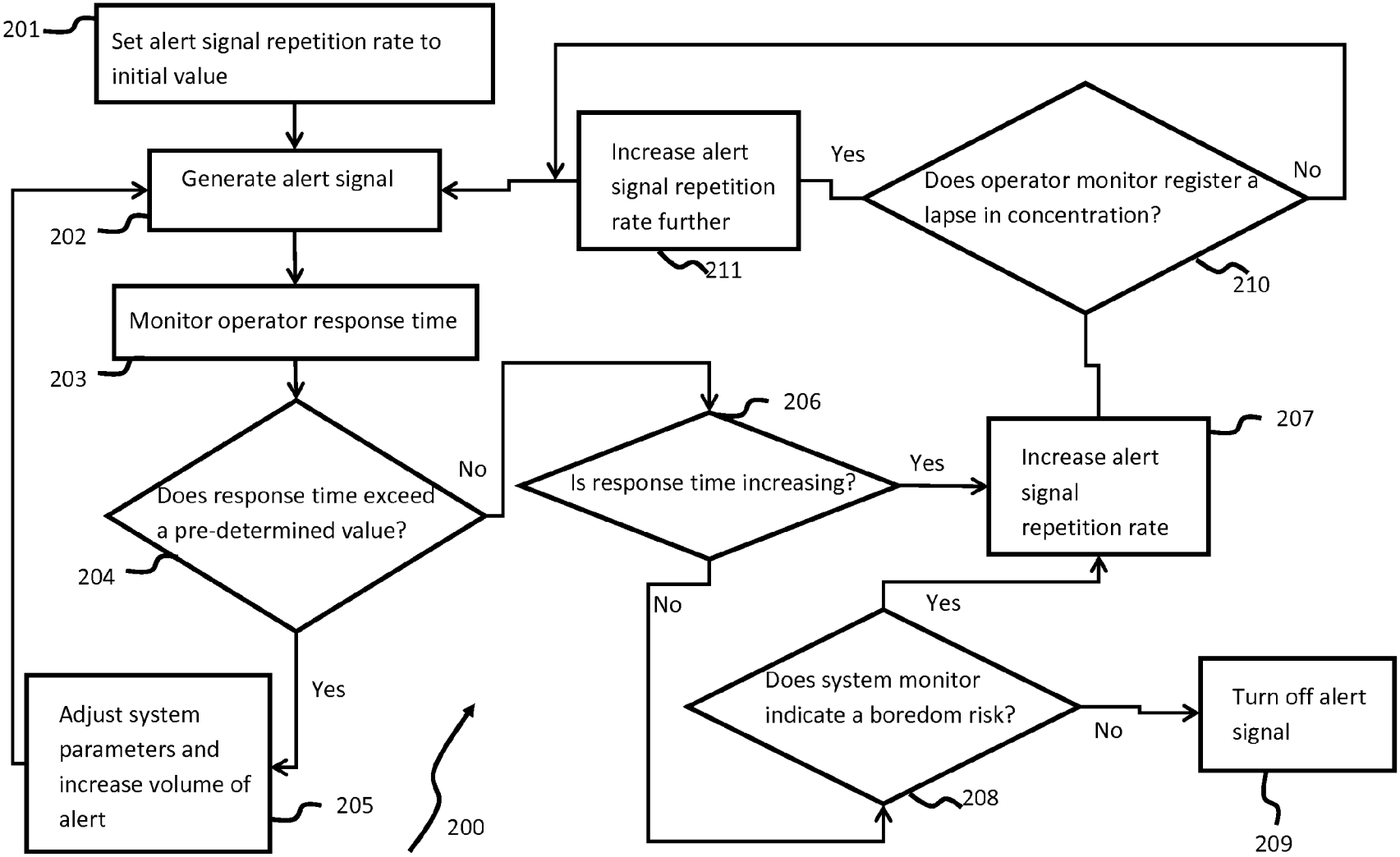
FIG. 2 shows a simplified flowchart of an example of a method for maintaining alertness of an operator of a manually-operated system.

Reference will now be made to FIG. 2 which shows a simplified flowchart of an exemplary method 200 of operating an apparatus for maintaining alertness of an operator of a manually operated system. The system may be a vehicle.

At step 201 a repetition rate for an alert signal is set to an initial value. In one example the alert signal may be set, initially, to "ping" every 5 minutes.

At step 202 the alert signal is generated by the first module 101 and can be heard by the operator (driver) through the loudspeaker 108.

In response to the ping, the driver pushes the button 109 enabling the second module 102 to monitor the operator's response time at step 203.

At the next step 204, the third module 103 determines whether or not the response time exceeds a predetermined value. If the response time does exceed the predetermined value, then this indicates that the operator (driver) may have suffered a severe loss of concentration or could even be falling asleep. This is a case where immediate action needs to be taken in order to maintain an acceptable operator alertness level. In this case the third module 103 may send a signal to the system control module 107 notifying it that an adjustment of operating system parameters is necessary, and may also send a signal to the first module 101 instructing it to increase the volume of the next alert signal (step 205).

In the vehicle example, vehicle parameters may be adjusted in a way that is likely to restore the concentration of the driver and increase his alertness level. Such adjustments may comprise reducing the speed of the vehicle or switching on the air conditioning or opening a window, for example.

If, on the other hand, the third module 103 determines that the response time does not exceed a predetermined value then the method proceeds to step 206 where the third module 103 determines whether or not the response time shows a tendency to increase (compared with previously monitored consecutive response times). If the third module 103 does detect a trend of increasing response times, then at step 207 the repetition rate is set to an increased value. A tendency for the response times to increase suggests that the operator may be distracted from his/her task or is becoming drowsy. Hence, in order to maintain an alertness level the repetition rate of the ping may be increased to one every 4 minutes rather than 5 minutes.

If on the other hand there is no increase in response time then the method progresses to step 208 where the third module 103 takes into account any signals from the system condition monitor 104 which indicate a boredom risk. In the vehicle example, at step 208 consideration may be given to inputs from vehicle on-board sensors which indicate the current driving conditions. For example if the on-board sensors indicate that the vehicle has been travelling at a constant speed for several minutes with no steering or gear changes then this suggests monotonous driving conditions which could be very boring for the driver. Alternatively, if the on-board sensors record frequent gear changes, frequent stopping and starting and frequent steering angle changes then this suggests that the workload of the driver is relatively high and his concentration level and alertness will be maintained. So if the input from a system condition monitor does not indicate a boredom risk then the alert signal may be turned off (step 209). Turning off the ping during periods of high workload is advantageous because otherwise the repeated pinging of the alert signal could become an irritation.

Reverting to step 208 again, if the input from a system condition monitor does indicate a boredom risk, then the process reverts to step 207 where the alert signal repetition rate is increased.

Subsequent to step 207, the increased repetition rate may be adjusted further depending on an input from the operator alertness monitor 105. In the motor vehicle example, at step 210 consideration may be given to inputs from vehicle on-board sensors which indicate the current concentration level of the driver. For example if the on-board sensors indicate that the driver's head is being turned away from the straight ahead position for lengthy periods of time or that a heart rate monitor suggests drowsiness then these signals may suggest a current or imminent lapse in concentration. In such cases, the alert signal repetition rate is increased further at step 211. For example the alert signal may be set to "ping" every 2 minutes. On the other hand if there is no indication that a lapse in concentration is current or imminent, then no further modifications to the repetition rate are made and the rate that was calculated at step 207 is fed to the first module 101 and the method recommences from step 202.

In situations where the alert signal has been turned off (step 209), it may be turned on again when he system condition monitor 104 indicate a boredom risk or when the operator alertness monitor 105 indicates a lapse in concentration.

The invention may also be implemented in a computer program for running on a computer system, at least including code portions for performing steps of a method according to the invention when run on a programmable apparatus, such as a computer system or enabling a programmable apparatus to perform functions of a device or system according to the invention. As an example, a tangible computer program product (100) may be provided having executable code stored therein for executing a process to perform a method for maintaining alertness of an operator of a manually-operated system, the tangible computer program product comprising code for periodically generating an alert signal for response thereto by the operator, monitoring a time interval between generation of an alert signal and receipt of a response from the operator, and adjusting a repetition rate of the alert signal depending on the monitored time interval.

A computer program is a list of instructions such as a particular application program and/or an operating system. The computer program may for instance include one or more of: a subroutine, a function, a procedure, an object method, an object implementation, an executable application, an applet, a servlet, a source code, an object code, a shared library/dynamic load library and/or other sequence of instructions designed for execution on a computer system.

The computer program may be stored internally on computer readable storage medium or transmitted to the computer system via a computer readable transmission medium. All or some of the computer program may be provided on computer readable media permanently, removably or remotely coupled to an information processing system. The computer readable media may include, for example and without limitation, any number of the following: magnetic storage media including disk and tape storage media; optical storage media such as compact disk media (e.g., CD-ROM, CD-R, etc.) and digital video disk storage media; nonvolatile memory storage media including semiconductor-based memory units such as FLASH memory, EEPROM, EPROM, ROM; ferromagnetic digital memories; MRAM; volatile storage media including registers, buffers or caches, main memory, RAM, etc.; and data transmission media including computer networks, point-to-point telecommunication equipment, and carrier wave transmission media, just to name a few.

A computer process typically includes an executing (running) program or portion of a program, current program values and state information, and the resources used by the operating system to manage the execution of the process. An operating system (OS) is the software that manages the sharing of the resources of a computer and provides programmers with an interface used to access those resources. An operating system processes system data and user input, and responds by allocating and managing tasks and internal system resources as a service to users and programs of the system.

The computer system may for instance include at least one processing unit, associated memory and a number of input/output (I/O) devices. When executing the computer program, the computer system processes information according to the computer program and produces resultant output information via I/O devices.

In the foregoing specification, the invention has been described with reference to specific examples of embodiments of the invention. It will, however, be evident that various modifications and changes may be made therein without departing from the broader spirit and scope of the invention as set forth in the appended claims.

The connections as discussed herein may be any type of connection suitable to transfer signals from or to the respective nodes, units or devices, for example via intermediate devices. Accordingly, unless implied or stated otherwise, the connections may for example be direct connections or indirect connections. The connections may be illustrated or described in reference to being a single connection, a plurality of connections, unidirectional connections, or bidirectional connections. However, different embodiments may vary the implementation of the connections. For example, separate unidirectional connections may be used rather than bidirectional connections and vice versa. Also, plurality of connections may be replaced with a single connections that transfers multiple signals serially or in a time multiplexed manner. Likewise, single connections carrying multiple signals may be separated out into various different connections carrying subsets of these signals. Therefore, many options exist for transferring signals.

Each signal described herein may be designed as positive or negative logic. In the case of a negative logic signal, the signal is active low where the logically true state corresponds to a logic level zero. In the case of a positive logic signal, the signal is active high where the logically true state corresponds to a logic level one. Note that any of the signals described herein can be designed as either negative or positive logic signals. Therefore, in alternate embodiments, those signals described as positive logic signals may be implemented as negative logic signals, and those signals described as negative logic signals may be implemented as positive logic signals.

Furthermore, the terms "assert" or "set" and "negate" (or "deassert" or "clear") are used herein when referring to the rendering of a signal, status bit, or similar apparatus into its logically true or logically false state, respectively. If the logically true state is a logic level one, the logically false state is a logic level zero. And if the logically true state is a logic level zero, the logically false state is a logic level one.

Those skilled in the art will recognize that the boundaries between logic blocks are merely illustrative and that alternative embodiments may merge logic blocks or circuit elements or impose an alternate decomposition of functionality upon various logic blocks or circuit elements. Thus, it is to be understood that the architectures depicted herein are merely exemplary, and that in fact many other architectures can be implemented which achieve the same functionality. For example, this functionality could be implemented in discrete logic, a state machine, a microcontroller with embedded memory or a microprocessor with external memory Any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

For example, the individual modules 101, 102, 103 illustrated in FIG. 1 may be combined to form fewer modules or just one module. Further, the entire functionality of the modules shown in FIG. 1 may be implemented in an integrated circuit. That is to say that apparatus for maintaining alertness of an operator of a manually-operated system may be implemented in an integrated circuit. Such an integrated circuit may be a package containing one or more dies. Alternatively, the examples may be implemented as any number of separate integrated circuits or separate devices interconnected with each other in a suitable manner.

Also for example, the examples, or portions thereof, may implemented as soft or code representations of physical circuitry or of logical representations convertible into physical circuitry, such as in a hardware description language of any appropriate type.

Also, the invention is not limited to physical devices or units implemented in non-programmable hardware but can also be applied in programmable devices or units able to perform the desired device functions by operating in accordance with suitable program code, such as mainframes, minicomputers, servers, workstations, personal computers, notepads, personal digital assistants, electronic games, automotive and other embedded systems, cell phones and various other wireless devices, commonly denoted in this application as 'computer systems'.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements The mere fact that certain measures are recited in mutually different claims does not indicate that a combination of these measures cannot be used to advantage.

The invention claimed is:

1. A method for maintaining alertness of an operator of a manually-operated system, the method comprising:

periodically generating an alert signal for response thereto by the operator;

monitoring a first time interval between generation of a first alert signal and receipt of a first response from the operator;

if the monitored first time interval is above a predetermined value, increasing a repetition rate of the alert signal; and if the monitored first time interval is below the predetermined value:

monitoring a second time interval between generation of a second alert signal and receipt of a second response from the operator; and if the monitored second time interval is greater than the first monitored time interval:

increasing a repetition rate of the alert signal to a next repetition rate based on the second time interval being greater than the first monitored time interval;

determining, based on vehicle on-board sensors, whether the operator meets a lapse in concentration characteristic after increasing repetition rate of the alert signal to the next repetition rate; and if the operator meets the lapse in concentration characteristic, further increasing the repetition rate of the alert signal from the next repetition rate to a further repetition rate.

2. The method of claim 1 wherein the alert signal is a visual signal.

3. The method of claim 1 wherein an alert signal is an audible signal.

4. The method of claim 3 wherein the volume of the audible signal is increased if the monitored first time interval exceeds a predetermined value.

5. The method of claim 1 wherein an alert signal is a haptic signal.

6. The method of claim 1 wherein the repetition rate of the alert signal is further adjusted depending on an output state of an operator alertness monitor.

7. The method of claim 1 wherein the repetition rate of the alert signal is further adjusted depending on the output state of a system condition monitor.

8. The method of claim 1 wherein a system parameter is adjusted if the monitored first time interval exceeds a predetermined value.

9. An apparatus to maintain alertness of an operator of a manually-operated system, the apparatus comprising:

a first module arranged to periodically generate an alert signal for response thereto by the operator;

a second module operably coupled to an operator-manipulated input and operably coupled to the first module and arranged to monitor a first time interval between generation of a first alert signal and receipt of a first response from the driver, and to monitor a second time interval between generation of a second alert signal and receipt of a second response from the driver; and a third module operably coupled to the first and second modules, the third module adapted to receive values of monitored first and second time intervals from the second module, determine a first adjusted repetition rate of an alert signal in response to the monitored first time interval being above a predetermined value and convey said first adjusted repetition rate to the first module, and determine a second adjusted repetition rate of an alert signal in response to the monitored second time interval being greater than the monitored first time interval and convey the second adjusted repetition rate to the first module, determine, based on vehicle on-board sensors, whether the operator meets a lapse in concentration characteristic after increasing repetition rate of the alert signal to the next repetition rate, and determine a third adjusted repetition rate of an alert signal in response to the operator meeting the lapse in concentration characteristic.

10. The apparatus of claim 9 wherein the third module is further arranged to receive an input from an operator alertness monitor and to determine an adjusted repetition rate of an alert signal dependent on said input from the operator alertness monitor.

11. The apparatus of claim 9 wherein the third module is further arranged to receive an input from a system condition monitor and to determine an adjusted repetition rate of an alert signal dependent on said input from the system condition monitor.

12. The apparatus of claim 9 wherein the third module is further arranged to generate control signal for connection to a system control module.

13. The tangible computer program product of claim 12 wherein the tangible computer program product comprises at least one from a group consisting of: a hard disk, a CD-ROM, an optical storage device, a magnetic storage device, a Read Only Memory, a Programmable Read Only Memory, an Erasable Programmable Read Only Memory, EPROM, an Electrically Erasable Programmable Read Only Memory and a Flash memory.

14. The apparatus of claim 9 wherein the apparatus is implemented in an integrated circuit.

15. The apparatus of claim 9 wherein the first alert signal is a visual signal.

16. The apparatus of claim 9 wherein the first alert signal is an audible signal.

17. The apparatus of claim 9 wherein the first alert signal is a haptic signal.

18. The apparatus of claim 9 wherein the third module is further arranged to further adjust the repetition rate of the alert signal depending on an output state of an operator alertness monitor.

19. The apparatus of claim 9 wherein the volume of the audible signal is increased if the monitored time interval exceeds a predetermined value.

20. A tangible computer program product having executable code stored therein for executing a process to perform a method for maintaining alertness of an operator of a manually-operated system, the tangible computer program product comprising code for:

periodically generating an alert signal for response thereto by the operator;

monitoring a first time interval between generation of a first alert signal and receipt of a first response from the operator;

if the monitored first time interval is above a predetermined value, increasing a repetition rate of the alert signal; and if the monitored first time interval is below the predetermined value:

monitoring a second time interval between generation of a second alert signal and receipt of a second response from the operator; and if the monitored second time interval is greater than the first monitored time interval increasing a repetition rate of the alert signal to a next repetition rate based on the second time interval being greater than the first monitored time interval;

determining, based on vehicle on-board sensors, whether the operator meets a lapse in concentration characteristic after increasing repetition rate of the alert signal to the next repetition rate; and if the operator meets the lapse in concentration characteristic, further increasing the repetition rate of the alert signal from the next repetition rate to a further repetition rate.

* * * * *